US006451519B1

(12) United States Patent
Craver et al.

(10) Patent No.: US 6,451,519 B1
(45) Date of Patent: Sep. 17, 2002

(54) BLEACH REGENERATOR COMPOSITION AND ITS USE TO PROCESS REVERSAL COLOR PHOTOGRAPHIC ELEMENTS

(75) Inventors: Mary Ellen Craver, Rochester; Jean Marie Buongiorne, Brockport; Michael John Haight, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 1200 days.

(21) Appl. No.: 08/778,644

(22) Filed: Jan. 3, 1997

Related U.S. Application Data

(62) Division of application No. 08/694,140, filed on Aug. 8, 1996, now Pat. No. 5,652,087, and a division of application No. 08/588,033, filed on Jan. 17, 1996.

(60) Provisional application No. 60/008,159, filed on Oct. 31, 1995.

(51) Int. Cl.[7] ..... G03C 7/42

(52) U.S. Cl. ..... 430/400; 430/430

(58) Field of Search ..... 430/398, 400, 430/430

(56) References Cited

U.S. PATENT DOCUMENTS

| | | | | | |
|---|---|---|---|---|---|
| 4,232,118 | A | | 11/1980 | Okauchi et al. | 430/574 |
| 4,822,725 | A | * | 4/1989 | Abe et al. | 430/393 |
| 4,923,785 | A | | 5/1990 | Frank | 430/430 |
| 5,002,860 | A | * | 3/1991 | Ishikawa et al. | 430/430 |
| 5,002,861 | A | * | 3/1991 | Nagazyo et al. | 430/430 |
| 5,011,763 | A | * | 4/1991 | Morimoto et al. | 430/430 |
| 5,055,382 | A | | 10/1991 | Long et al. | 430/400 |
| 5,114,835 | A | * | 5/1992 | Sakanoue | 430/393 |
| 5,270,148 | A | * | 12/1993 | Morigaki et al. | 430/430 |
| 5,342,740 | A | | 8/1994 | Goto et al. | |
| 5,352,567 | A | * | 10/1994 | Okada et al. | 430/393 |
| 5,449,593 | A | * | 9/1995 | Morigaki et al. | 430/372 |

FOREIGN PATENT DOCUMENTS

| | | |
|---|---|---|
| JP | 03-048245 | 7/1989 |

OTHER PUBLICATIONS

Tetenal trade literature, pp. 24–25 (unknown date).

* cited by examiner

*Primary Examiner*—Hoa Van Le
(74) *Attorney, Agent, or Firm*—J. Lanny Tucker

(57) ABSTRACT

A ferric-EDTA bleach regenerator composition can be mixed with bleach overflow to provide a bleach replenisher for reversal color silver halide photographic processes. The bleach regenerator composition has a critically controlled pH between about 6.0 and about 6.5, and comprises a total bromide ion concentration of at least about 210 g/l, and ferric ion in an amount of at least about 50 g/l. At least 50% of the bleach overflow and the bleach regenerator composition are mixed in at least a 1:1 volume ratio. After pH adjustment to from about 5.4 to about 5.6, the pH adjusted replenisher is supplied to the bleach tank for use in the process.

10 Claims, No Drawings

BLEACH REGENERATOR COMPOSITION AND ITS USE TO PROCESS REVERSAL COLOR PHOTOGRAPHIC ELEMENTS

This is a Divisional of application Ser. No. 60/008,159 filed Oct. 31, 1995, and subsequently converted to 111-A Ser. No. 08/588,033, filed Jan. 17, 1996, and filed as a Rule 60 Divisional Ser. No. 08/694,140, on Aug. 8, 1996, recently allowed,. U.S. Pat. No. 5,652,089.

FIELD OF THE INVENTION

This invention relates in general to color photography and in particular to methods and compositions useful in the processing of color reversal photographic elements. More particularly, this invention relates to a bleach regenerator composition, and its use in the processing of the noted elements.

BACKGROUND OF THE INVENTION

Multicolor, multilayer photographic elements are well known in the art. Such materials generally have three different selectively sensitized silver halide emulsion layers coated on one side of a single support. Each layer has components useful for forming a particular color in an image. Typically, they utilize color forming couplers that form yellow, magenta and cyan dyes in the sensitized layers during processing.

After color development, it is necessary to remove the silver image that is formed coincident with the dye image. This can be done by oxidizing the silver using a suitable oxidizing agent, commonly referred to as a bleaching agent, followed by dissolving the silver halide so formed using what is known as a fixing agent.

A commercially important process intended for use with color reversal photographic elements that contain color couplers in the emulsion layers, or layers contiguous thereto, uses the following sequence of processing steps: first developing, washing, reversal bath, color developing, bleaching, fixing, washing and stabilizing.

In the past, in continuous processing methods, including processing of reversal color materials, the various processing solutions have been discarded after use. However, more recently, used processing solutions have been collected and reused, at least in part because of the environmental problems the waste solutions create, as well as the high costs in collection and discard of the solutions. Thus, used solutions have been reused by adding them to the processing baths as "replenishers" to the various solutions. Considerable efforts are being carried out in the industry to find ways to regenerate the components of the waste solutions so they can be reused as replenishers, further reducing waste streams. For example, a bleach replenishing composition is added to the bleach tank to keep the necessary components at the appropriate levels. This bleach replenisher can be composed of, in part, bleach composition overflow.

As environmental needs increase in various countries, the industry is striving to find ways to further reduce photoprocessing effluent from the various processing baths. Thus, efforts have been made to regenerate the bleaching solution overflow and to supply the regenerated replenisher solution to the bleach tank as the replenishment solution. One known bleach regenerator solution for reversal color processes is sold by Tetenal of Germany (sold as Tetenal Bleachbath E6/E6AR BL-RCY), which has a pH of about 7, and contains a relatively high bromide ion concentration (approximately 190–210 g/l).

There is also a desire in the industry to use a more concentrated bleach regenerator so more bleaching solution overflow can be utilized to make the bleach replenisher, thereby reducing effluent even further. The commercial product available from Tetenal, however, has limited shelf life stability at its "neutral" pH. It was considered that its pH might be lowered to increase stability, but when this was done, its solubility was decreased and precipitation resulted after several days. Another problem with the commercial Tetenal regenerator solution is that when acid is added to it to lower its pH to the level needed for converting it to a regenerated replenisher, the bleaching capacity of the resultant bleach tank solution is degraded.

There is a need therefore for a more stable bleach regenerator composition that can be used in highly concentrated form to provide a regenerated bleach replenisher at lower pH.

SUMMARY OF THE INVENTION

The problems noted above have been overcome using a method for processing a reversal color silver halide photographic element comprising:

A) bleaching an imagewise exposed, color developed reversal color silver halide photographic element in a bleaching tank with a bleaching composition comprising a complex of ferric ethylenediaminetetraacetic acid as the bleaching agent, B) supplying a bleach replenisher to the bleaching tank to result in an overflow of used bleaching composition from the bleaching tank, C) mixing at least 50% of the overflow, in at least a 1:1 volume ratio, with a bleach regenerator composition to obtain a regenerated bleach replenisher, the bleach regenerator composition having a pH of from about 6.0 to about 6.5, and comprising a total bromide ion concentration of at least about 210 g/l, and complex of ferric ion and ethylenediaminetetraacetic acid, the ferric ion being present in an amount of at least about 50 g/l, D) adjusting the pH of the regenerated bleach replenisher prepared in step C to from about 5.4 to about 5.6, and E) replenishing the bleaching composition of step A in the bleaching tank with the pH adjusted regenerated bleach replenisher prepared in step D, using a bleach replenishment rate of less than or equal to about 215 ml/m$^2$.

This invention also provides a bleach regenerator composition having a pH of from about 6.0 to about 6.5, and comprising a total bromide concentration of at least about 210 g/l, and a complex of ferric ion and ethylenediaminetetraacetic acid, the ferric ion being present in an amount of at least about 50 g/l.

Further, a pH adjusted regenerated bleach replenisher composition comprises a ferric complex of ethylenediaminetetraacetic acid and having a pH of from about 5.4 to about 5.6, the regenerated bleaching replenisher composition provided by mixing:

overflow from a ferric ethylenediaminetetraacetic acid bleaching solution with the pH adjusted bleach regenerator composition described above, in at least a 1:1 volume ratio to form a regenerated bleach replenisher, followed by adjusting the pH of the regenerated bleach replenisher to from about 5.4 to about 5.6.

The present invention effectively provides a bleach regenerator composition and bleach replenisher for processing reversal color silver halide photographic materials. The bleach regenerator composition is more stable and stays in solution even at lower pH for extended periods of time. The composition is highly concentrated, for example, in the ferric ion concentration, so that more bleach overflow can be used to form the bleach replenisher.

These advantages are achieved by using a bleach regenerator at considerably lower pH, that is, 6.0–6.5, and thus stability is improved. However, in order to maximize the concentration of the components, the level of bromide salt and hydrobromic acid have been adjusted to provide a reformulated and improved composition.

DETAILED DESCRIPTION OF THE INVENTION

A wide variety of reversal color photographic elements can be used in the practice of the present invention. A detailed description of such materials is found, for example, in *Research Disclosure,* publication 36544, pages 501–541 (September, 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as *"Research Disclosure"*. More details about such elements are provided herein below.

Reversal color photographic elements utilized in the practice of this invention are typically comprised of a support having on one side thereof a plurality of photosensitive silver halide emulsion layers. The photosensitive layers can contain any of the conventional silver halides as the photosensitive material, for example, silver chloride, silver bromide, silver bromoiodide, silver chlorobromide, silver chloroiodide, silver chlorobromoiodide, and mixtures thereof. Useful support materials include cellulose acetate film, polyvinylacetal film, polycarbonate film, polystyrene film, polyethylene terephthalate film, and the like. The silver halide is dispersed within a suitable hydrophilic colloid such as gelatin or derivatives thereof. The silver halide emulsion layers can contain a variety of well-known addenda, including but not limited to, chemical sensitizers, development modifiers and antifoggants.

As explained above, a well-known color reversal process of the prior art utilizes a first developer, a reversal bath, a color developer, a conditioning solution, a bleach bath, a fixing bath and a stabilizer bath. Alternatively, the stabilizer bath can be replaced with a typical wash or rinse solution, and a "prebleach" or "conditioner" bath is used for stabilizing the color image after color development and prior to bleaching. The components that are useful in each of such baths are well known in the photographic art. The improved process of this invention can utilize the same baths.

The first developer generally contains a black-and-white developing agent or a mixture thereof. Useful developing agents include, but are not limited to, dihydroxybenzene developing agents (such as hydroquinone), 3-pyrazolidone developing agents (such as 1-phenyl-3-pyrazolidone), and aminophenol developing agents (such as paraaminophenol). In addition to the developing agent, the first developer typically contains other agents such as preservatives, sequestering agents, restrainers, antifoggants, buffers and silver halide solvents.

The reversal bath generally contains a nucleating agent, such as a boron compound or a chelated stannous salt (such as stannous chloride) that functions as a reducing agent, as well as antioxidants, buffers, fungicides and sequestering agents.

In addition to an aromatic primary amino color developing agent, the color developing bath typically contains sequestering agents, buffering agents, preservatives, antioxidants, competing couplers and silver halide solvents.

Particularly useful aromatic primary amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include, but are not limited to, N,N-diethyl-p-phenylenediamine monohydrochloride, 4-N,N-diethyl-2-methylphenylene-diamine monohydrochloride, 4-(N-ethyl-N-2-methanesulfonylaminoethyl)-2-methylphenylenediamine sesquisulfate monohydrate, 4-(N-ethyl-N-2-hydroxyethyl)-2-methyl-phenylenediamine sulfate, 4-N,N-diethyl-2,2-methanesulfonylaminoethyl-phenylenediamine hydrochloride, and others readily apparent to a skilled worker in the art.

The essential component of the bleaching bath is a bleaching agent that converts metallic silver to silver ions. Other common components of the bleaching bath include halides, sequestering agents and corrosion inhibitors. One or more ammonium or alkali metal salts of a ferric complex of ethylenediaminetetraacetic acid are useful as bleaching agents in this invention.

The fixing bath converts all silver halide into soluble silver complexes that diffuse out of the emulsion layers. Fixing bath retained within the layers of the photographic element is removed in a subsequent water washing step. Thiosulfates, including ammonium thiosulfate and alkali metal thiosulfates (such as sodium thiosulfate and potassium thiosulfate), are particularly useful as fixing agents. Other components of the fixing bath include preservatives and sequestering agents.

A wide variety of different color reversal processes are well known in the art. For example, a single color developing step can be used when the coupling agents are incorporated in the photographic element or three separate color developing steps can be used in which coupling agents are included in the developing solutions. The reversal step can be carried out by use of a reversal bath, by a re-exposure step, or by incorporating a fogging agent in the color developing bath. In order to provide shorter processing times, bleaching and fixing can be combined in a single step (known as a bleach-fixing step).

Stabilization solutions are also known in the art for use in reversal photoprocessing methods. Such solutions generally include formaldehyde or an equivalent material to stabilize magenta dye image. Further details of such solutions are provided, for example, in U.S. Pat. No. 4,786,583 (Schwartz et al), incorporated herein by reference.

Alternatively and preferably, stabilization is achieved by using a prebleach or conditioning solution after color development and prior to bleaching. The various details of such solutions and their use are provided, for example, in U.S. Pat. No. 4,921,779 (Cullinan et al), U.S. Pat. No. 4,975,356 (Cullinan et al), U.S. Pat. No. 5,037,725 (Cullinan et al), and U.S. Pat. No. 5,334,493 (Fujita et al), all incorporated herein by reference. Other optional features of useful conditioning solutions are provided in copending and commonly assigned U.S. Ser. No. 08/393,293, filed Feb. 23, 1995, describing the inclusion of specific amounts of secondary amines in the conditioning bath, and in copending and commonly assigned U.S. Ser. No. 08/417,416, filed Apr. 5, 1995, describing concentrated conditioning solutions.

The bleaching composition used in this invention comprises a complex of ferric ion and ethylenediaminetetraacetic acid in a suitable concentration. The amount of iron (III) is generally from about 50 to about 58 g/l. One or more salts of the complex can be used if desired. The bleaching composition is supplied to the bleach tank in a suitable rate to result in an overflow of used bleaching solution from the bleaching tank. Generally, the rate of supply is less than or equal to about 215 ml/m$^2$, and preferably from about 140 to about 215 ml/m$^2$.

At least 50%, preferably from about 50 about 80%, and more preferably from about 50 to about 75%, of the bleaching composition overflow is mixed with the bleach regenerator composition to obtain a regenerated bleach replenisher. The mixing is carried out in at least a 1:1 volume ratio of bleaching composition overflow to bleach regenerator composition, and up to about 9:1. Preferably, the volume ratio of mixing is from about 1:1 to about 3:1.

After mixing, the pH of the regenerated bleach replenisher is adjusted downward to from about 5.4 to about 5.6 by adding a suitable amount of an organic or inorganic acid, such as acetic acid, succinic acid, maleic acid, tartaric acid, malonic acid, or nitric acid. Acetic acid is preferred. The amount of acid to be added could be readily determined by routine experimentation, depending upon the pH of the regenerated bleach replenisher and the particular acid used. For acetic acid, the amount added is generally from about 10 to about 20 ml/l. One advantage of this invention is that less acid needs to be added to the regenerated bleach replenisher than to conventional regenerator solutions.

The pH adjusted regenerated bleach replenisher is then added to the bleaching tank as the "bleach replenisher" at a bleach replenishment rate of less than or equal to about 215 ml/m$^2$ and preferably at from about 140 to about 215 ml/m$^2$.

The bleach regenerator composition used in the method of this invention has a pH of from about 6.0 to about 6.5 (preferably from about 6.0 to about 6.2). It includes the bleaching agent, a ferric ion complex of ethylenediaminetetraacetic acid in an amount to provide ferric ion in an amount of at least about 50 g/l, and preferably at from about 50 to about 58 g/l. Ferric ion can be supplied for the complex as a suitable ferric salt or oxide, such as ferric nitrate, ferric sulfate, ferric oxide or ferric bromide. Ferric oxide or ferric nitrate is preferred. The complex can be provided as an ammonium or alkali metal salt, as well as the free acid.

Also included in the bleach regenerator composition are one or more sources of bromide ion such that the total bromide ion is present in an amount of at least about 210 g/l, preferably at from about 215 to about 240 g/l, and most preferably at from about 220 to about 240 g/l. Preferably, total bromide ion is provided by a combination of hydrobromic acid and a bromide salt (such as sodium bromide, potassium bromide, ammonium bromide or lithium bromide). More preferably, at least about 80%, more preferably from about 80 to about 97%, of the total bromide ion is provided from the bromide salt, and the remainder from the hydrobromic acid. Ammonium bromide is most preferred.

One or more corrosion inhibitors can also be included in the bleach regenerator composition if desired at suitable concentrations. Preferably, such corrosion inhibitors include, but are not limited to, the potassium salts of nitrate, silicate, chromate and phosphate. Hexamethylenetetraamine and benzotriazole can also be used. Potassium nitrate is preferred.

A preferred embodiment of this invention is a bleach regenerator composition having a pH of from about 6.0 to about 6.2, and comprising:

a) a total bromide ion concentration of from about 220 to about 240 g/l provided by a combination of hydrobromic acid and a bromide salt, the amount from the bromide salt being from about 80 to about 97% of the total bromide ion, b) a complex of ferric ion and ethylenediaminetetraacetic acid, the ferric ion being present in an amount of from about 50 to about 58 g/l, and c) a corrosion inhibitor.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerable details of the element structure and components, and suitable methods of processing various types of elements are described in *Research Disclosure,* noted above. All types of emulsions can be used in the elements, including but not limited to, thin tabular grain emulsions, and either positive-working or negative-working emulsions.

The present invention is particularly useful to process imagewise exposed and developed photographic elements containing arylpyrazolone type magenta dye forming color couplers. Such color couplers are well known in the art. One such compound is described in U.S. Pat. No. 5,037,725 (noted above). Useful cyan dye and yellow dye forming couplers that can be incorporated into such elements are also well known.

The elements are typically exposed to suitable radiation to form a latent image and then processed as described above to form a visible dye image.

The bleaching step described above is generally carried out for from about 4 to about 8 minutes, but longer times can be used if desired. Preferably, the bleaching time is about 6 minutes. The temperature at which bleaching is carried out is generally above room temperature, for example from about 30 to about 40° C.

Processing according to the present invention can be carried out using conventional deep tanks holding processing solutions. Alternatively, it can be carried out using what is known in the art as "low volume thin tank" processing systems having either vertical rack and tank or horizontal automatic tray designs. Such processing methods and equipment are described, for example, in U.S. Pat. No. 5,436,118 (Carli et al) and publications cited therein, incorporated herein by reference.

As used herein to define amounts and times, "about" refers to ±10% of the indicated value. In reference to temperatures, "about" refers to ±5° C. In defining pH, "about" refers to ±0.05 pH unit.

The following examples are provided for illustrative purposes only and are not intended to be limiting in any way. Unless otherwise indicated, all percentages are by volume.

EXAMPLE 1

Preferred Bleach Regenerator Composition

A preferred bleach regenerator composition of this invention was prepared by mixing the following in water (added to make 1 liter total): commercially available 1.56 molar ammonium ferric-ethylenediaminetetraacetic acid (788 g), hydrobromic acid (61.5 g), ammonium bromide (243.9 g) and potassium nitrate (67 g). The final pH was 6.0–6.2.

EXAMPLE 2

Preferred Regenerated Bleach Replenisher Composition & Comparison

The bleach regenerator composition of Example 1 was mixed with seasoned conventional color reversal bleach composition overflow comprising 1.56 molar ammonium ferric-ethylenediaminetetraacetic acid bleaching agent (277 g/l), bromide ion from various salts (73.8 g/l), and potassium nitrate (25 g/l). The volume ratio of bleach composition (which is comparable to bleach overflow) to bleach regenerator composition was 1:1. The resulting regenerated bleach replenisher had a pH of 5.95–6.1. The pH was then adjusted downward to 5.4–5.6 by adding acetic acid (18 ml/l) to provide a pH adjusted regenerated bleach replenisher that can be directly added to a bleach bath to process reversal color silver halide photographic materials.

As noted above, the amount of acetic acid needed to adjust the pH of the regenerated bleach replenisher was only 18 ml/l. However, when the commercially available Tetenal Bleachbath E6/E6AR BL-RCY regenerator solution was used in a similar fashion, it was necessary to add acetic acid at about 30 ml/l in order to obtain the desired pH. Thus, clearly the present invention allows one to reduce the amount of acid in preparing a bleach replenisher, and this acid reduction provides advantages as noted above.

EXAMPLE 3

Processing Reversal Color Photographic Elements

The regenerated bleach replenisher compositions of this invention were evaluated in otherwise conventional reversal color photographic processing.

The invention was used to process samples of a conventional color reversal photographic films (available from Eastman Kodak Company) using the following processing protocol. This film contained a conventional 1-aryl-5-pyrazolone magenta color coupler in one of the emulsion layers.

| Processing Protocol: | |
|---|---|
| 6 minutes | First Development* |
| 2 minutes | Water wash |
| 2 minutes | Reversal bath** |
| 6 minutes | Color development*** |
| 2 minutes | Prebleach@ |
| 6 minutes | Bleaching**** |
| 4 minutes | Fixing# |
| 4 minutes | Water wash |
| 30 seconds | Final wash## |
| 20 minutes | Drying |

*Using conventional Process E-6 KODAK ™ First Developer.
**Using conventional Process E-6 KODAK ™ Reversal Bath.
***Using conventional Process E-6 KODAK ™ Color Developer.
@Using conventional Process E-6 KODAK ™ Prebleach and Replenisher.
****Using conventional Process E-6 KODAK ™ Bleach (Ferric-EDTA bleaching agent).
#Using conventional Process E-6 KODAK ™ Fixer.
Using conventional Process E-6 KODAK ™ Final Rinse.

The method of this invention was carried out by taking at least 50% of the bleach bath overflow and mixing it (at a 1:1 volume ratio) with the bleach regenerator composition of Example 1. This mixing was carried out for about 3 minutes at 20–25° C. in a separate vessel. The mixture pH of 5.9–6.1 was then adjusted downward by adding acetic acid as described in Example 2, and the adjusted mixture was then added to the bleach bath as a replenisher for the process. This method was carried out for at least 4 bleach tank turn-overs, or for at least 330 $m^2$ of processed reversal color photographic film. The results of processing were highly acceptable. That is, use of the noted regenerated bleach composition provided highly acceptable processing of the film.

EXAMPLES 4–6

Effects of pH in Bleach Regenerator Composition

Experiments were carried out to show the critical importance of the bleach regenerator composition having a pH of from about 6.0 to about 6.5.

Several regenerator compositions like that described in Example 1 above were subjected to keeping tests to see if crystallization or precipitation would occur. The various compositions had components like Example 1 and various pH values as shown in Table I below.

The results of the keeping tests are shown in Table I for the various compositions. Column 1 lists the keeping temperatures (from −18 to +21° C.) at which the compositions were stored for 14 days. Column 2 shows when the crystallization results were observed (at room temperature) after the compositions were removed from the keeping environment, i.e. "Observation Time After Removal". Thus, samples of each composition were observed immediately ("0" time), 24 hours, and 11 days after they were removed from the keeping environment. Crystals of ammonium ferric ethylenediaminetetraacetic acid complex were measured by visual inspection and identified by Fourier Transform Infrared (FTIR) spectroscopy.

TABLE I

| Keeping Temperature | Observation Time After Removal | Crystallization/Precipitation Results ** Control A pH = 5.76 | Control B pH = 5.89 | Example 4 pH = 6.00 | Example 5 pH = 6.10 | Example 6 pH = 6.50 | Control C pH = 6.90 |
|---|---|---|---|---|---|---|---|
| −18° C. | 0 | none | 0.3 cm | none | none | none | none |
| | 24 hours | " | cover ½ bottom | " | " | " | " |
| | 11 days | 0.6 cm | 0.3 cm | " | " | " | " |
| −7° C. | 0 | 1 crystal | few | none | none | none | none |
| | 24 hours | 5 crystals | bottom covered | " | " | " | " |
| | 11 days | 0.6 cm | 0.3 cm | " | " | " | " |
| +5° C. | 0 | 1 crystal | 0.6 cm | none | none | none | none |
| | 24 hours | 5 crystals | bottom covered | " | " | " | " |
| | 11 days | 0.3 cm | 0.6 cm | " | " | " | " |
| +10° C. | 0 | 1 crystal | few | none | none | none | none |
| | 24 hours | 10 crystals* (51) | bottom covered* (52.7) | none* (53.3) | none* (53.2) | " | " |
| | 11 days | NA | NA | none | none | NA | NA |
| +21° C. | 0 | NA | NA | none | none | none | none |
| | 24 hours | NA | NA | " | " | " | " |
| | 11 days | NA | NA | NA | NA | NA | NA |

NA = not available
*( ) Measured Total Iron (g/l) in supernatant
** Precipitates identified by FTIR as ammonium ferric-EDTA The results indicate that best time and temperature stability for the composition is achieved when the pH is at least 6.0. It is noted that Control C, while being stable at a pH above 6.5, is undesirable because at such high pH, unacceptably high amounts of acid must be added to the regenerated bleach replenisher to lower the pH to an acceptable level before it can be added to the bleach bath as replenisher.

In addition, several bleaching compositions were subjected to high temperature (49° C.) keeping for 12 days. Examples 4 and 6 were compared to three "Control" bleaching compositions outside this invention, including Control C identified above. Control D was a commercial Process E-6 (reversal) Bleach Replenisher containing ferric ethylenediaminetetraacetic acid bleaching agent and having pH 5.4. Control E was a commercial highly concentrated (1.56 mol/l) ammonium ferric ethylenediaminetetraacetic acid, KODAK BL-1, having pH 7.0.

The results of ferrous ion build-up (g/l) after keeping are listed in Table II below. It was observed that the pH dropped in all compositions during the high temperature keeping test, but subsequent freezing of the compositions did not cause precipitation.

TABLE II

| Composition | pH | Ferrous Ion Buildup (g/l) |
|---|---|---|
| Control D | 5.4 | 7 |
| Example 4 | 6.0 | 33 |
| Example 6 | 6.5 | 37 |
| Control C | 6.9 | 40 |
| Control E | 7.0 | 60 |

To determine if the change in pH after keeping might diminish bleaching performance of the regenerator compositions, Examples 4 and 6 and Control C were formulated into working strength bleaching solutions, and were then used to bleach three different commercially available reversal color films: KODAK EKTACHROME™ 400 HC Film, KODAK EKTACHROME™ ELITE™ 100 Film and KODAK EKTACHROME™ 64 Professional Film. A solution made from a pH 6.5 concentrate, which had been kept at room temperature, was used as the "Standard" solution. All compositions were brought to the same total iron level and then aerated to oxidize any ferrous ion to ferric ion. Once this was completed, the compositions were all pH adjusted to the standard bleaching pH of 5.8.

Table III below lists the "bleach clear times" for each regenerator composition tested. "Bleach clear time" refers to the time at which all metallic silver has been converted to silver halide for subsequent dissolution and removal in the following fixing step. The results indicate that a regenerator composition pH of 6.0–6.5 is desired for improved composition keeping.

TABLE III

| Composition | Bleach Clear Time (seconds) |
|---|---|
| Standard | 252 |
| Example 4 | 313 |
| Example 6 | 342 |
| Control C | 337 |

EXAMPLE 7

Effect of Bromide Level in Bleach Regenerator Composition

Experiments were also carried out to show the effect of bromide ion concentration in the bleach regenerator composition of this invention.

A $2^4$ factorial experiment with optimized "aims" was carried out around the chemical ingredients of a conventional Process E-6 bleaching solution. One of those components is bromide ion. The level of bromide ion was varied while all other components were kept at optimized levels for processing two different commercially available color reversal photographic films, and the bleach "clear time" (seconds to convert all silver metal to silver halide) was determined. The optimized or "aim" level for bromide ion in the bleaching solution was considered to be about 73.4 g/l. The following Table IV lists the data obtained.

TABLE IV

| Bromide Ion (g/l) | Predicted Clear Film #1 | Bleaching Time (seconds Film #2 | Average Δ Clear Time (seconds) |
|---|---|---|---|
| 65.8 | 301 | 309 | |
| 73.4 (aim) | 273 | 282 | 44 |
| 81.0 | 259 | 263 | |

As one can see from these data, the average reduction in "clear time" during bleaching for processing the two films from varying the bromide ion level, was 44 seconds. This was surprising to us. It had been previously thought that because the bromide ion in conventional replenisher is relatively high (145–150 g/l), that the amount of bromide ion "used" during bleaching would not have a significant impact on the rate of bleaching (and thus, the bleaching "clear time"). These experiments proved otherwise and showed the significant potential magnitude of the impact from increased bromide ion concentration.

We discovered that with reuse or regeneration of the bleaching solution (in which case, the bromide ion is "used up" repeatedly and tank concentration would drop below levels seen in conventional replenishment), additional bromide ion must be-added to compensate for the usage, as well as for the deterioration in bleaching rate (and thus, bleach "clear time") due to additional build-up of carryover products.

Bleach replenisher provides three benefits to the tank bleaching solution:

1) dilution of chemicals carried in and undesirable chemicals produced in chemical reactions,
2) addition of chemicals, such as bromide ion, to make up for those used in chemical reactions necessary for bleaching, and
3) make up for chemicals that are diluted by carryover or carried out into the next solution (i.e. the fixing solution).

The conventional Tetenal Process E-6 bleach regenerator has bromide ion levels which account only for the first and third benefits noted above. We have found that this is inadequate, and that the level of bromide ion in the bleach regenerator must also be adjusted for bromide ion used up in the bleaching reaction (approximately 14–18 g/l of replenisher when processing elements containing 4.3–5.4 g silver/$m^2$). Thus, we determined that the level of bromide ion needed to be increased in the regenerator composition that is used to provide a regenerated bleach replenisher, and the present invention reflects that fact.

The invention has been described in detail with particular reference to preferred embodiments thereof, but it will be understood that variations and modifications can be effected within the spirit and scope of the invention.

We claim:

1. A pH adjusted regenerated bleach replenisher composition comprising a ferric complex of ethylenediaminetetraacetic acid and having a pH of from about 5.4 to about 5.6, said pH adjusted regenerated bleach replenisher composition provided by mixing:

at least 50% of the overflow from a ferric-ethylenediaminetetraacetic acid bleaching solution with a bleach regenerator composition having a pH of from about 6.0 to about 6.5, and comprising hydrobromic acid and a lithium, potassium or ammonium bromide salt sufficient to provide a total bromide ion concentration of from about 210 to about 240 g/l, at least from about 80 to about 97% of said bromide ion being provided by said lithium, potassium or ammonium bromide salt, and a complex of ferric ion and ethylenediaminetetraacetic acid, the ferric ion being present in an amount of from about 50 to about 58 g/l, in at least a 1:1 volume ratio to form a regenerated bleach replenisher, followed by adjusting the pH of said regenerated bleach replenisher to from about 5.4 to about 5.6.

2. The regenerated bleach composition of claim 1 wherein said bleach regenerator composition has a pH of from about 6.0 to about 6.2, the total bromide ion concentration is from about 215 to about 240 g/l.

3. The regenerated bleach composition of claim 1 wherein the volume ratio of said overflow to said bleach regenerator composition is up to 9:1.

4. The regenerated bleach replenisher composition of claim 1 wherein said bleach regenerator composition has a pH of from about 6.0 to about 6.2.

5. The regenerated bleach replenisher composition of claim 1 wherein said bleach replenisher composition has a total bromide ion concentration of from about 215 to about 240 g/l.

6. The regenerated bleach replenisher composition of claim 1 wherein said bleach replenisher composition further comprises a corrosion inhibitor.

7. The regenerated bleach replenisher composition of claim 6 wherein said corrosion inhibitor is potassium nitrate.

8. The regenerated bleach replenisher composition of claim 1 wherein the volume ratio of said overflow to said bleach regenerator composition is from about 1:1 to about 3:1.

9. The regenerated bleach replenisher composition of claim 1 prepared by adjusting its pH with acetic acid, succinic acid, maleic acid, tartaric acid, malonic acid or nitric acid.

10. The regenerated bleach replenisher composition of claim 9 prepared by adjusting its pH with acetic acid.

* * * * *